US007222445B2

(12) United States Patent
Schmidt

(10) Patent No.: US 7,222,445 B2
(45) Date of Patent: May 29, 2007

(54) RUG HOOKING FRAME

(76) Inventor: Stephen Schmidt, 4921 Pleasant Oaks Dr., Wilmington, NC (US) 28412

( * ) Notice: Subject to any disclaimer, the term of this patent is extended or adjusted under 35 U.S.C. 154(b) by 151 days.

(21) Appl. No.: 11/208,902

(22) Filed: Aug. 22, 2005

(65) Prior Publication Data

US 2007/0039214 A1 Feb. 22, 2007

(51) Int. Cl.
*D05C 1/02* (2006.01)
*D05B 91/06* (2006.01)

(52) U.S. Cl. ..... 38/102.91; 38/102.21

(58) Field of Classification Search ..... 38/102, 38/102.1, 102.2, 102.21, 102.4, 102.9, 102.91; 160/371, 378, 380, 398, 404; 269/237; 101/127.1
See application file for complete search history.

(56) References Cited

U.S. PATENT DOCUMENTS 800,591 A * 9/1905 Payen ..... 38/102.4
2,180,059 A * 11/1939 Kandle ..... 38/102.2
2,832,171 A 4/1958 Batey
3,226,861 A 1/1966 Bird
3,466,706 A * 9/1969 Asano ..... 269/94
3,601,912 A 8/1971 Dubbs
3,908,293 A 9/1975 Newman
3,922,804 A * 12/1975 Batey ..... 38/102.91
4,189,856 A 2/1980 Cookson
4,315,645 A 2/1982 Knox
4,430,814 A 2/1984 Wulc
4,525,909 A 7/1985 Newman
4,658,522 A 4/1987 Kramer
4,995,178 A * 2/1991 Randolph ..... 38/102
5,226,250 A * 7/1993 Ulmer et al. ..... 38/102.9
5,293,704 A 3/1994 Brown
5,794,528 A 8/1998 Gronig et al.
6,209,240 B1 4/2001 Engle
6,212,800 B1 4/2001 Bagley

* cited by examiner

*Primary Examiner*—Ismael Izaguirre
(74) *Attorney, Agent, or Firm*—MacCord Mason PLLC

(57) ABSTRACT

The present invention is an apparatus for uniformly pulling a base fabric taut for rug hooking. The apparatus includes an open rectangular frame having spaced parallel upper and lower members and spaced parallel side members having upper surfaces in a common plane. Grippers are pivotally supported on each of the frame members, wherein each of the grippers has a hinged outer edge and an upper surface adapted to grip the base fabric. Each gripper is independently pivotal between a relaxed position wherein the upper surface is parallel to the frame common plane and a raised position in which its upper surface is inclined outwardly. The apparatus further includes gripper actuators each having a gripper engagement end and a hand engagement end. The actuators are pivotal between a relaxed position and an engaged position, whereby the actuator moves the gripper to its raised position when the actuator is moved to the engaged position.

20 Claims, 3 Drawing Sheets

RUG HOOKING FRAME

BACKGROUND OF THE INVENTION (1) Field of the Invention

The present invention relates to an apparatus for use in uniformly stretching fabric, and more particularly to an apparatus for uniformly stretching a coarse woven textile fabric and holding the fabric taut during the crafting of rugs and other textile articles.

(2) Description of the Prior Art

In handcrafting of rugs, a rectangular fabric segment is stretched in all directions to form a rug base. Yarns of different colors are then inserted in a pattern through the base fabric to form the rug design. In order to construct a rug that will maintain its desired shape, it is critical to uniformly stretch the base fabric in all directions and hold the fabric taut during rug construction. Otherwise, the shape of the rug will be distorted when the stretching forces on the rug are released.

Base fabrics are normally stretched with devices known as rug hooking frames, with several different frames being commercially available. The most basic and usually least expensive hooking frame is the hand-tightened hoop frame, which is comprised of inner and outer hoops. The base fabric is placed over the inner hoop and the outer hoop is pressed downwardly around the inner hoop to stretch and lock the fabric base between the hoops. The hoop frame is not sufficiently robust for anything other than small rugs, needlework, etc. Moreover, stretching of the rectangular fabric around a circular base does not provide the stretch uniformity desired.

A more robust and effective mechanically assisted rug-hooking frame is the lap frame, which can be supported by the user's lap or mounted on a floor support. The lap frame comprises an open rectangular frame having frame arms over which the fabric base is stretched. The fabric is secured to fabric grippers, such as strips of card clothing like that used in the card clothing presses of textile manufacturing, aligned along the sides of the frame.

Stretching of the fabric base over existing lap frames can be difficult and complex. Moreover, the fabric may not be stretched with the uniformity desired. Current mechanically assisted lap frames use a variety of relatively complex mechanisms involving gears and springs to stretch and clamp the fabric over the frame. U.S. Pat. No. 3,922,804 to Batey, for example, discloses a rectangular frame having two fixed frame arms and two moveable frame arms that include gears and springs.

A need remains for a rug hooking frame that can be used to uniformly stretch a fabric in both the side-to-side direction (herein the X-axis) and from top-to-bottom or front-to-back, depending on the orientation of the frame (herein the Y-axis) with a high degree of uniformity, while permitting ready release of the fabric when separation from the hooking frame is desired.

SUMMARY OF THE INVENTION

The rug hooking frame of the present invention is comprised of an open rectangular frame with spaced parallel front and rear frame members and spaced parallel side frame members, pivotal grippers carried on each of the frame sections, and actuator means to pivot the grippers between relaxed positions and raised positions. Each frame member has inside, outside, upper and lower surfaces, with the upper surfaces being in a common plane.

Each fabric gripper includes inside, outside, upper and lower surfaces, and is pivotally attached adjacent its outside surface to a frame section, so that the gripper can be pivoted between a relaxed position wherein the gripper upper surfaces are in a common plane parallel to the plane of the upper surface of the frame members and a raised or taut position in which the gripper upper surfaces are inclined outwardly. The upper surface of each gripper is adapted to releasably grip the fabric base.

During use, the grippers are moved to their relaxed position with the fabric being smoothly placed over and gripped by the grippers. Movement of the grippers to their raised positions, as more fully described hereinafter, uniformly stretches the fabric along the X-axis and the Y-axis. The grippers may also be pivoted to a stored position in which the gripper upper surface is facing downwardly, preventing damage to the gripper surfaces, or injury to the user due to inadvertent contact with the grippers.

The preferred grippers of the present invention are comprised of strips of card clothing carried on gripper bases that are pivotally attached to the frame members. For the purposes of this disclosure, card clothing is a material having a plurality of fine upright and closely spaced wires that include bent ends useable to grip textile fabrics.

The grippers preferably also include means to urge the grippers towards their relaxed position. The preferred means are frame member magnets in either the upper frame member surface or the lower gripper surface, aligned with corresponding magnets or metal discs in the opposed surface. Springs or other means could be used for this purpose.

The present apparatus also includes gripper actuators used to move the grippers between their relaxed positions and their raised positions. Each gripper actuator has a gripper engagement end, a hand engagement end, and a longitudinal axis extending through the two ends. Each actuator is pivotally mounted with its longitudinal axis extending toward a frame member, and is pivotal intermediate its two ends between a relaxed position and an engaged position, so that the gripper engagement end engages and urges the gripper to its raised position when the actuator is moved to its engaged position.

The preferred gripper actuators are generally rectangular blocks hinged into recesses within each frame member. Each block has a planar inner surface and a planar outer surface. The gripper actuators are hinged at points within their respective recesses such that each block inner surface is flush with each frame member upper surface when the gripper actuators are in their relaxed position and perpendicular to the frame member upper surface when in the engaged position. The inner surfaces of the actuators are preferably curved at the gripper engagement ends.

The gripper lower surfaces are preferably parallel to the common plane of the frame members when the grippers are in the relaxed position and rest on the inner surfaces of the actuators. Thus, when the actuators are pivoted from their relaxed positions to their engaged positions, the engagement ends of the actuators ride along the lower surfaces of the grippers, lifting the grippers to their raised positions as the actuators are moved to their engaged and perpendicular positions. When in their engaged positions, the angularity of the actuators relative to the grippers lock the grippers in their raised positions until the actuators are manually returned to their relaxed positions.

The rug-hooking frame of the present invention further includes a support member for holding the frame at an angle relative to horizontal. The support member comprises horizontally spaced legs having upper sections attached to the frame members and lower sections attached to a base plate used to support the frame on a user's lap during a rug hooking session.

A user prepares the rug-hooking frame of the present invention for operation by moving all of the gripper actuators to their relaxed position using their respective hand engagement ends. The grippers are then in their relaxed positions, with the lower surfaces of the grippers resting on the horizontal inner surfaces of the actuators.

Next, the user places a rug base fabric over the frame and manually pulls the base fabric outwardly in all directions to eliminate fabric wrinkles within the boundary of frame member. Once the rug fabric has been arranged as desired, the user manually moves each of the gripper actuators independently to their engaged position, causing the gripper engagement ends of the actuators to ride along the lower surfaces of the grippers. Movement of the grippers actuators generates a camming action that urges the grippers to their raised position, thereby uniformly pulling the rug base fabric taut in both the X-axis and Y-axis directions. The gripper actuators are locked in their engaged position throughout the rug hooking session due to the perpendicular positions of the actuators, which hold the grippers at an angle, e.g., about 30 degrees relative to horizontal, with the actuators being held in the engaged positions by the downward forces of the grippers.

To remove the rug base fabric from the frame, the user moves all gripper actuators to their relaxed position using their respective actuators. This action allows all of the grippers to pivot inwardly, thereby releasing the tension on the rug base fabric, which in turn allows the user to remove the rug base fabric from frame. Once a rug hooking session is concluded, the grippers can be manually pivoted at least 180 degrees from their relaxed position such that each gripper upper surface is substantially inclined downwardly to prevent the gripper upper surfaces from being inadvertently damaged during storage.

Other objectives of the invention will become apparent to one skilled in the art upon reading the following detailed description of the invention, taken with the drawings.

DETAILED DESCRIPTION OF THE DRAWINGS

In the following description, terms such as horizontal, upright, vertical, above, below, beneath and the like, are used solely for the purpose of clarity in illustrating the invention, and should not be taken as words of limitation. The drawings are for the purpose of illustrating the invention, and are not intended to be to scale.

Figure 1:
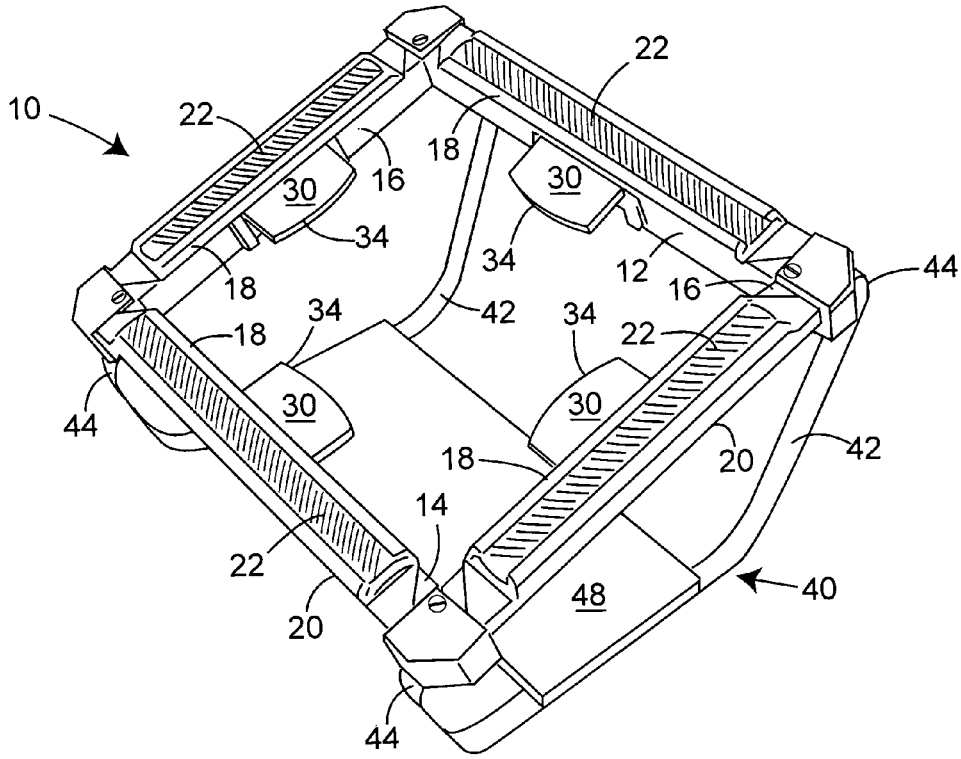
FIG. 1 is a perspective view of the rug-hooking frame of the present invention.
Figure 2:
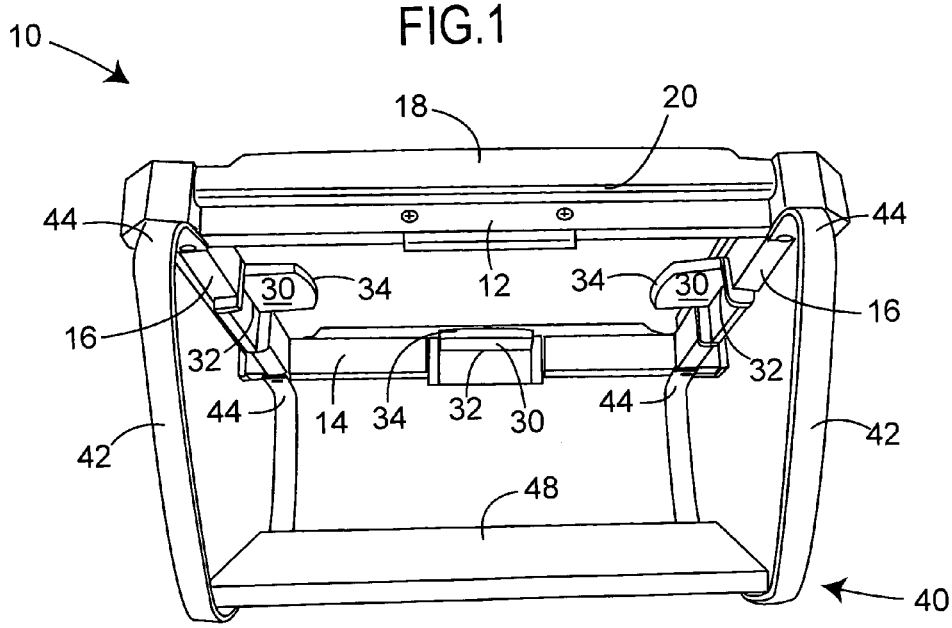
FIG. 2 is a front view of the rug-hooking frame of the present invention.
Figure 3:
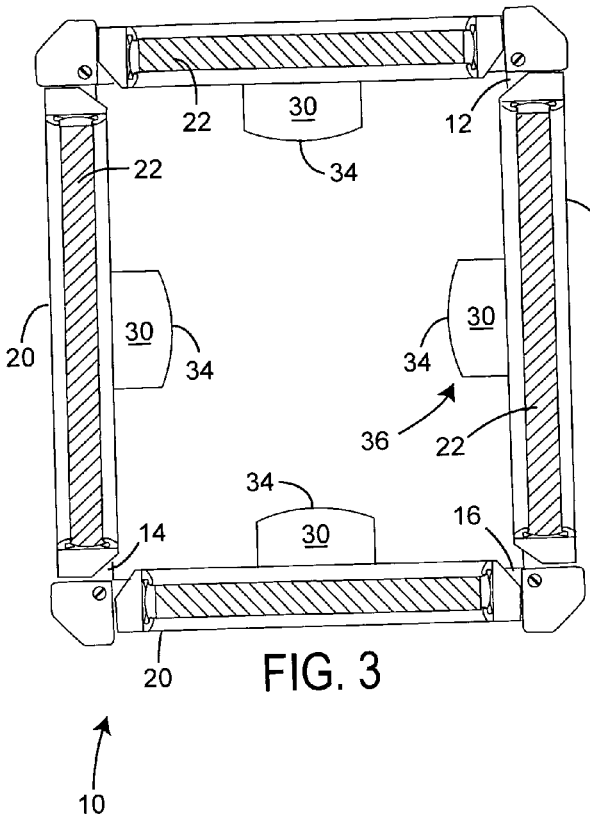
FIG. 3 is a top view of the rug-hooking frame of the present invention showing the gripper actuators and the grippers in their relaxed position.

As shown in FIGS. 1 and 2, the rug-hooking frame of the present invention, generally 10, comprises an open rectangular frame having a spaced parallel upper member 12 and a lower member 14, along with spaced parallel side members 16. Frame members 12, 14 and 16 have upper surfaces in a common plane. Grippers 18 are pivotally supported on frame members 12, 14 and 16. Each of grippers 18 has a hinged outer edge 20, an upper surface 22 adapted to grip a base fabric, and a lower surface 24. Each gripper 18 is pivotal between a relaxed position shown in FIGS. 1-4 wherein upper surface 22 is parallel to the frame common plane and a raised position shown in FIGS. 5 and 6 in which the upper surface 22 is inclined outwardly.

Figure 5:
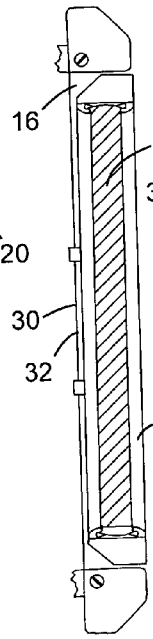
FIG. 5 is a top view of a gripper actuator and gripper of the present invention showing the gripper in its raised position.
Figure 4:
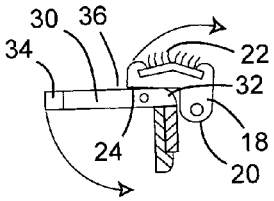
FIG. 4 is a cross-sectional view of a gripper actuator and gripper of FIG. 3 showing the gripper in its relaxed position.
Figure 6:
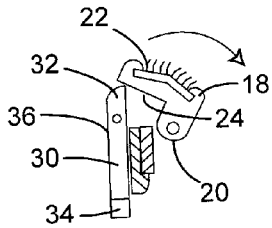
FIG. 6 is a cross-sectional view of the gripper actuator and gripper of FIG. 5 showing the gripper in its raised position.

Gripper actuators 30 each have a gripper engagement end 32, a hand engagement end 34, and an inner surface 36 curved at end 32, and are pivotal between a relaxed position shown in FIG. 4 in which surface 36 is parallel to the common plane of the frame with the inner surface of gripper 18 resting on inner surface 36, and an engaged position shown in FIG. 5 in which actuator 30 is perpendicular to the common plane with engagement end 32 holding gripper 18 in the raised and locked position. Gripper engagement end 32 slides along lower surface 24 of gripper 18 as actuator 30 is manually moved to engaged position 38.

Figure 7:
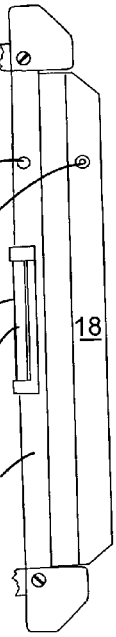
FIG. 7 is a top view of a gripper of the present invention in its stored position.
Figure 8:
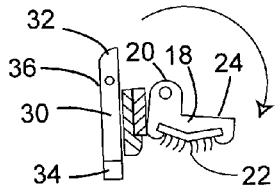
FIG. 8 is a cross-sectional view of the gripper of FIG. 7 showing the gripper in its stored position.

A third position, shown in FIGS. 7 and 8 illustrate gripper 18 in its stored position in which gripper upper surface 22 is substantially facing downwardly. The stored position is helpful in preventing injury to the user or damage to materials that might be contacted by the grippers. FIG. 7 also shows a means to urge the grippers into their relaxed position. The preferred means is a magnet 39 embedded into the frame members and a metal disc 41 embedded into the underside of gripper 18.

Figure 9:
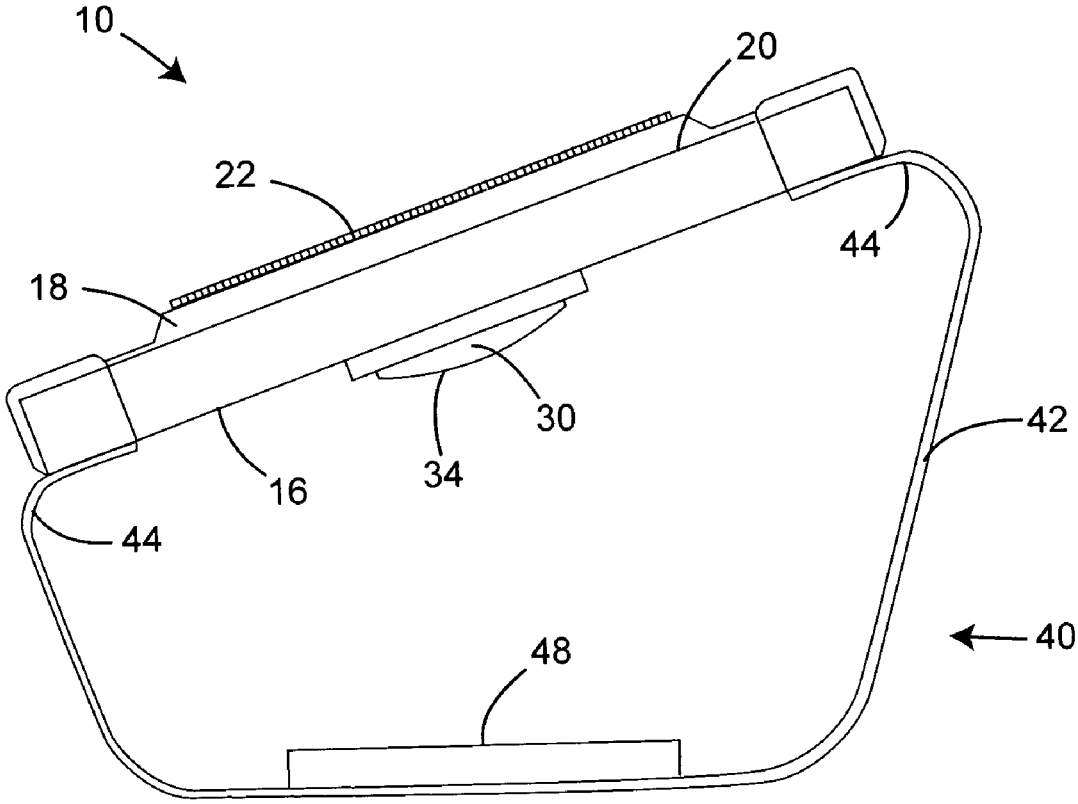
FIG. 9 is a side view of the rug-hooking frame.

As best viewed in FIGS. 1, 2 and 9, rug-hooking frame 10 further includes a support member 40 to hold the frame at an angle relative to horizontal. The preferred angle ranges between zero degrees and forty-five degrees. Support member 40 comprises horizontally spaced legs 42 having upper sections 44 attached to frame members 12, 14 and 16 and lower sections 46 attached to a base plate 48 for resting frame 10 upon the lap of a person during a rug hooking session.

In operation, the user moves all of gripper actuators 30 to their relaxed position using their respective hand engagement ends 32. Grippers 18 are in their relaxed positions with their lower surfaces 24 resting on the inner surfaces 36 of actuators 30. Inner surfaces 36 are in a common plane with the upper surfaces of frame members 12, 14 and 16. Next, the user places a rug base fabric over frame 10 and aligns the fabric on frame members 12, 14 and 16.

Once the rug fabric is arranged as desired, the user independently moves all of gripper actuators 30 to their engaged position thereby urging grippers 18 to their raised position as the engagement ends 32 ride along inner surfaces 24, urging grippers 18 to pivot outwardly, and pulling the rug base fabric taut along the X-axis and Y-axis. Gripper actuators 30 remain in their engaged position throughout the rug hooking session. To remove the rug base fabric from frame 10, the user moves all gripper actuators 30 to their relaxed position using their respective hand engagement ends 32. This action allows all of grippers 18 to pivot inwardly thereby releasing the tension on the rug base fabric, which in turn allows the user to remove the rug base fabric from frame 10.

Once a rug hooking session is concluded, the user may want to ready frame 10 for storage. Grippers 18 can be manually pivoted at least one hundred and eighty degrees from their relaxed position 26 such that gripper upper surface 22 is substantially inclined downwardly to prevent gripper upper surface 22 from being inadvertently damaged during storage.

Upon a reading of the foregoing description, it will be apparent that the present apparatus is a substantial improvement over prior art devices for the same use in that each gripper is independently pivotal between relaxed and raised positions, resulting in uniform stretching of fabric bases in both the X-axis and Y-axis directions.

Certain modifications and improvements will occur to those skilled in the art upon a reading of the foregoing description. It should be understood that all such modifications and improvements have been deleted for the sake of conciseness and readability but are properly within the scope of the following claims. It will also be understood that the present apparatus, while described in the context of use in rug construction, can also be used to provide a taut fabric for use in other yarn crafting activities.

What is claimed is:

1. An apparatus for holding a base fabric taut during rug hooking comprising:

a) an open rectangular frame having spaced parallel upper and lower members and spaced parallel side members, said member having upper surfaces in a common plane;

b) grippers pivotally supported on each of said frame members, each of said grippers having a hinged outer edge and an upper surface adapted to grip said base fabric, each of said grippers being pivotal between a relaxed position wherein said upper surface is parallel to said frame member and a raised position in which said upper surface is inclined outwardly; and c) gripper actuators having a gripper engagement end and a hand engagement end, said actuators being pivotal between a relaxed position and an engaged position, each of said gripper actuators moving a gripper to its raised position when said actuator is moved to the engaged position.

2. The apparatus of claim 1, further including a support member for holding said frame with said common plane at an angle of 0 degrees to an angle of 45 degrees relative to horizontal.

3. The apparatus of claim 1, wherein said grippers are made of strips of card clothing.

4. The apparatus of claim 1, wherein said gripper actuators are parallel to said common plane when said gripper actuators are in their relaxed position.

5. The apparatus of claim 1, wherein said gripper actuators are perpendicular to said common plane when said gripper actuators are in their engaged position.

6. The apparatus of claim 1, further including a means to urge said grippers into their relaxed position.

7. The apparatus of claim 1, wherein said grippers each further include a stored position in which said gripper upper surfaces are substantially facing downwardly.

8. An apparatus for holding a base fabric taut during rug hooking comprising:

a) an open rectangular frame having spaced parallel upper and lower members and spaced parallel side members, said members having upper surfaces in a common plane;

b) grippers including card clothing strips being pivotally supported on each of said frame members, each of said grippers having a hinged outer edge and an upper surface adapted to grip said base fabric, said gripper being pivotal between a relaxed position wherein said upper surface is parallel to said frame member and a raised position in which said upper surface is inclined outwardly; and c) gripper actuators having a gripper engagement end and a hand engagement end, said actuators being pivotal between a relaxed position and an engaged position, each of said actuators independently moving one of said grippers to its raised position when said actuator is moved to the engaged position.

9. The apparatus of claim 8, further including a support member to hold said frame with said common plane at an angle of 0 degrees to an angle of 45 degrees relative to horizontal.

10. The apparatus of claim 9, wherein said support member comprises horizontally spaced legs having upper sections attached to said open rectangular frame and lower sections attached to a base plate to support said apparatus on a user's lap.

11. The apparatus of claim 8, wherein said gripper actuators are parallel to said common plane when said gripper actuators are in their relaxed position.

12. The apparatus of claim 8, wherein said gripper actuators are perpendicular to said common plane when said gripper actuators are in their relaxed position.

13. The apparatus of claim 8, further including a means to urge said grippers toward their relaxed position.

14. The apparatus of claim 8, wherein each of said grippers each has a stored position in which said gripper upper surface inclined substantially downwardly.

15. An apparatus for holding a base fabric taut during rug hooking comprising:

a) an open rectangular frame having spaced parallel upper and lower members and spaced parallel side members, said members having upper surfaces in a common plane;

b) grippers including card clothing strips pivotally supported on each of said frame members, each of said grippers having a hinged outer edge and an upper surface adapted to grip said base fabric, said gripper being pivotal between a relaxed position wherein said upper surface is parallel to said common plane and a raised position in which said upper surface is inclined outwardly; and c) gripper actuators having a gripper engagement end and a hand engagement end, said actuators being pivotal between a relaxed position and an engaged position, said gripper engagement end moving said gripper to its raised position when said actuator is moved to the engaged position, and wherein said gripper actuators are parallel to said common plane when said gripper actuators are in their relaxed position.

16. The apparatus of claim 15, wherein said gripper actuators are perpendicular to said common plane when said gripper actuators are in their engaged position.

17. The apparatus of claim 15, further including a support member to hold said frame with said common plane at an angle of 0 degrees to an angle of 45 degrees relative to horizontal.

18. The apparatus of claim 15, wherein said support member comprises horizontally spaced legs having upper sections attached to said open rectangular frame and lower sections attached to a base plate to support said apparatus on a user's lap.

19. The apparatus of claim 15, further including magnets to urge said grippers into their relaxed position.

20. The apparatus of claim 15, wherein each of said grippers each has a stored position in which said gripper upper surface inclined substantially downwardly.

* * * * *